US011118362B2

(12) United States Patent
Münzenmaier et al.

(10) Patent No.: US 11,118,362 B2
(45) Date of Patent: Sep. 14, 2021

(54) METHOD AND SYSTEM FOR THE HYDRAULIC CONTROL OF A CONCRETE PLACING BOOM

(71) Applicant: Putzmeister Engineering GmbH, Aichtal (DE)

(72) Inventors: Werner Münzenmaier, Nürtingen (DE); Francisco Martin Brugué, Darmstadt (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 17/063,754

(22) Filed: Oct. 6, 2020

(65) Prior Publication Data

US 2021/0017776 A1 Jan. 21, 2021

Related U.S. Application Data

(63) Continuation of application No. PCT/EP2019/060499, filed on Apr. 24, 2019.

(30) Foreign Application Priority Data

Apr. 24, 2018 (DE) ..... 10 2018 109 789.1

(51) Int. Cl.
*F15B 7/00* (2006.01)
*E04G 21/04* (2006.01)
*F15B 11/16* (2006.01)

(52) U.S. Cl.
CPC ..... *E04G 21/0463* (2013.01); *F15B 7/003* (2013.01); *F15B 11/161* (2013.01); *E04G 21/0436* (2013.01)

(58) Field of Classification Search
CPC ..... F15B 11/16; F15B 11/161; F15B 11/165; F15B 7/003; F15B 2211/171; E04G 21/0463; E04G 21/0436
See application file for complete search history.

(56) References Cited

U.S. PATENT DOCUMENTS 6,202,013 B1 * 3/2001 Anderson ..... B66C 13/40 701/50
6,883,532 B2 * 4/2005 Rau ..... B66C 13/066 137/1

(Continued)

FOREIGN PATENT DOCUMENTS

DE 10 2005 035 981 A1 2/2007
WO WO 02/064912 A1 8/2002
WO WO-2015073329 A1 * 5/2015 ..... F15B 11/0445

OTHER PUBLICATIONS

English translation of the International Search Report, PCT/EP2019/060499, dated Jul. 11, 2019, 2 pages.

(Continued)

*Primary Examiner* — Thomas E Lazo

(74) *Attorney, Agent, or Firm* — Bose McKinney & Evans LLP

(57) ABSTRACT

A method and system for the hydraulic control of a concrete placing boom (14) comprising a plurality of boom arms (16), wherein hydraulic drive cylinders (18) for the boom arms (16), which are connected to one another in an articulated manner, are controlled by a hydraulic circuit (34), wherein a supply pressure is supplied via a hydraulic pump (32) to the hydraulic circuit (34), and wherein a pressure signal is captured in the drive cylinders (18) by at least one pressure sensor (38) for each cylinder. The maximum pressure in the drive cylinders (18) is determined from the pressure signals and the supply pressure is adjusted by an electronic control unit (36) according to the maximum pressure.

18 Claims, 2 Drawing Sheets

(56) References Cited

U.S. PATENT DOCUMENTS

| | | | | |
|---|---|---|---|---|
| 7,487,707 | B2 * | 2/2009 | Pfaff | F15B 11/003 91/437 |
| 8,925,310 | B2 * | 1/2015 | Pirri | E02F 9/2207 60/469 |
| 2008/0072749 | A1 | 3/2008 | Pfaff et al. | |

OTHER PUBLICATIONS

English translation of the International Preliminary Report on Patentability and Written Opinion of the International Searching Authority, PCT/EP2019/060499, dated Nov. 5, 2020, 8 pages.

* cited by examiner

METHOD AND SYSTEM FOR THE HYDRAULIC CONTROL OF A CONCRETE PLACING BOOM

CROSS REFERENCE TO RELATED APPLICATIONS

This application is a continuation of PCT/EP2019/060499 filed on Apr. 24, 2019 which claims priority from DE 10 2018 109 789.1 filed on Apr. 24, 2018, the disclosures of both of which are hereby incorporated herein by reference.

BACKGROUND

A hydraulic circuit arrangement is known from DE 10 2005 035 981 A1, in which, for a start-up phase of a concrete placing boom, a control group with a switching valve that responds to the load pressure is provided, which brings an adjusting element of the hydraulic pump into its position for maximum flow rate below a predetermined minimum value of the load pressure. The pickups for the load pressures transmitted by hydraulic control lines are located on the consumer side of proportional valves for controlling the drive cylinders, wherein they are passed on via a shuttle valve chain. Since so-called load holding valves are provided on the drive cylinders, the captured load pressures are initially zero. The higher the fixed specification for the switching valve is set, the higher the system pressure over a longer period of time, which results in a corresponding energy loss.

In current control systems for concrete placing booms, such as those sold by the applicant as so-called EBC control (ergonomic boom control), the operator can use a joystick on a remote control to control all boom arms simultaneously with the aid of a computer, so that targeted movements in a machine coordinate system are possible without any special handling effort. For this purpose, pressure signals are captured directly in the drive cylinders. For example, the boom could be located in an arched position, so that in order to move the boom tip or the end hose horizontally, individual boom arms have to be lifted and others have to be bent. In this coupled mode, due to the required pressure build-up, the boom arm or drive cylinders, which are subject to low loads due to their position, react earlier than drive cylinders with a higher load. This can cause the boom to vibrate and undesirably influence the trajectory curve of the boom tip.

SUMMARY

The present disclosure relates to a method for the hydraulic control of a concrete placing boom that includes a plurality of boom arms, in which hydraulic drive cylinders designed to drive the boom arms that are connected to one another in an articulated manner are controlled via a hydraulic circuit, wherein a supply pressure is supplied to the hydraulic circuit via a hydraulic pump, and a pressure signal is captured in the drive cylinders by at least one pressure sensor in each case. The invention further relates to a system for carrying out such a method.

Proceeding from this, the disclosed embodiments improve the methods and systems for boom control known in the prior art and of specifying a pressure adjustment as quickly as possible, in particular for improving the trajectory curve during boom movement.

Advantageous embodiments and further developments will become apparent from the present disclosure.

The disclosed embodiments are based on the idea of using pressure measurement values which are tapped directly from the drive cylinders as electrically transmitted signals for electronic pilot control of the supply pressure. Accordingly, it is proposed that the maximum pressure in the drive cylinders is determined from the pressure signals and that the supply pressure is adjusted by an electronic control unit in accordance with the maximum pressure. The electrical signal transmission avoids dead times or runtime effects in hydraulic control chains, while the supply pressure dependent on the current or instantaneous boom position can be set precisely as a manipulated variable by the electronic control unit. This results in more precise trajectory curves and reduced vibrations, especially in the start-up phase, and without an excess of hydraulic energy being required.

To avoid a delayed pressure build-up, it is also advantageous if the pressure signals are transmitted as electrical signals from the pressure sensors to the electronic control unit via electrical signal lines. The pressure sensors, for example, which operate as piezoresistive or strain-measuring pressure transducers, convert the physical measured variable for pressure into an electrical signal, in particular a standard bus signal, for example for a CAN bus.

In order to avoid hydraulic signal lines, it is advantageous if the pressure signals are tapped directly on the bottom side and/or the rod side of the drive cylinder.

For electronic signal processing, it is advantageous if the electrical pressure signals are transmitted to a comparator of the control device which may, e.g., be formed by an electronic circuit or software.

For an indirect adjustment of the supply pressure, it is advantageous if the supply pressure is adjusted by a controllable pressure limiting valve as an actuator connected to a feed line of the hydraulic pump, in particular via a branch line.

In order to avoid runtime effects here too, and to enable a sensitive pressure setting, it is advantageous if the pressure limiting valve is actuated via an electrical control line, in particular by means of a magnet.

In a simple circuit variant, it is provided that the hydraulic pump is designed as a constant pump.

Alternatively, it is also possible for the supply pressure to be adjusted by regulating a hydraulic pump designed as a variable pump via a hydraulic or electrical pump regulator.

In order to ensure a sufficient supply for all hydraulic consumers, the supply pressure should be set to the value of the maximum pressure or a value above it by a predetermined amount.

The electronic control can be variably adapted to the fact that the respective pressure in the drive cylinders is influenced by the instantaneous or current position of the boom arms, wherein a starting position can be taken into account.

In order to enable robust operation, it is advantageous if the supply pressure is set independently of the pressure signals of the pressure sensors after a start-up phase of the concrete placing boom, in particular by means of a load-sensing controller.

For a boom movement that is as exact as possible, it is favorable if the drive cylinders are acted upon by a working pressure derived from the supply pressure via an associated actuator of the hydraulic circuit, in particular a proportional directional control valve.

A further increase in practical utility results from the fact that the movement of the boom arms of the concrete placing boom is coordinated with computer support according to the specification of travel commands.

It is also favorable if the maximum pressure is determined from the pressure signals at the beginning of a movement phase, in particular when the concrete placing boom is approached.

With regard to a control system, it is proposed that an electronic control unit is designed to determine a maximum pressure from the pressure signals at least when starting the concrete placing boom and to adapt the supply pressure in accordance with the maximum pressure. This results in system advantages analogous to the advantageous effects explained in the introduction.

In order to enable rapid signal transmission directly from the drive cylinders to the control unit, it is advantageous if the pressure sensors are connected to the control unit on the output side via electrical signal lines.

The control unit advantageously has a comparator to which the pressure signals are applied to determine the maximum pressure, so that complex hydraulic valve chains for a pressure comparison can be dispensed with.

A flexible adaptation is made possible in that the control unit has an evaluation routine for determining a target value of the supply pressure depending on the maximum pressure.

Another system advantage results from the fact that the control unit has a hydraulic or electrical pump regulator or a controllable pressure limiting valve connected to a feed line of the hydraulic pump for adapting the supply pressure.

BRIEF DESCRIPTION OF THE DRAWINGS

In the following, the invention will be explained in more detail with reference to the embodiments schematically illustrated in the drawings. In the drawings.

Figure 1:
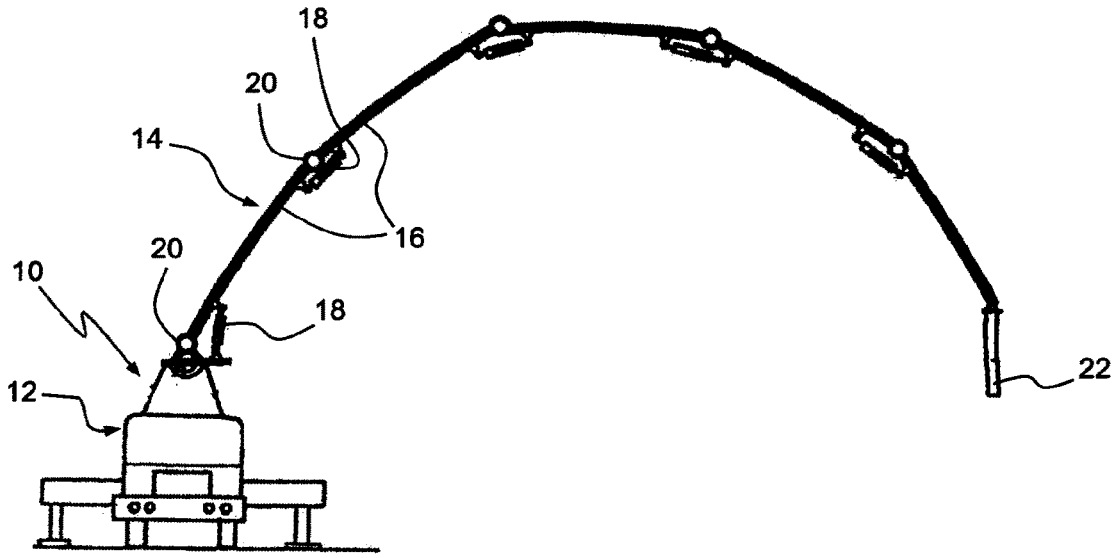
FIG. 1 shows a side view of a truck-mounted concrete pump with a concrete placing boom that can be moved by hydraulic drive cylinders on its boom arms.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The truck-mounted concrete pump 10 shown in a supported working position in FIG. 1 comprises a vehicle 12 and a concrete placing boom 14 that can be transported therewith, of which the boom arms 16 connected to one another in an articulated manner can be pivoted about a respective joint 20 by means of a hydraulic drive cylinder 18, so that an end hose 22 for distribution of concrete can be positioned in the work area.

Figure 2:
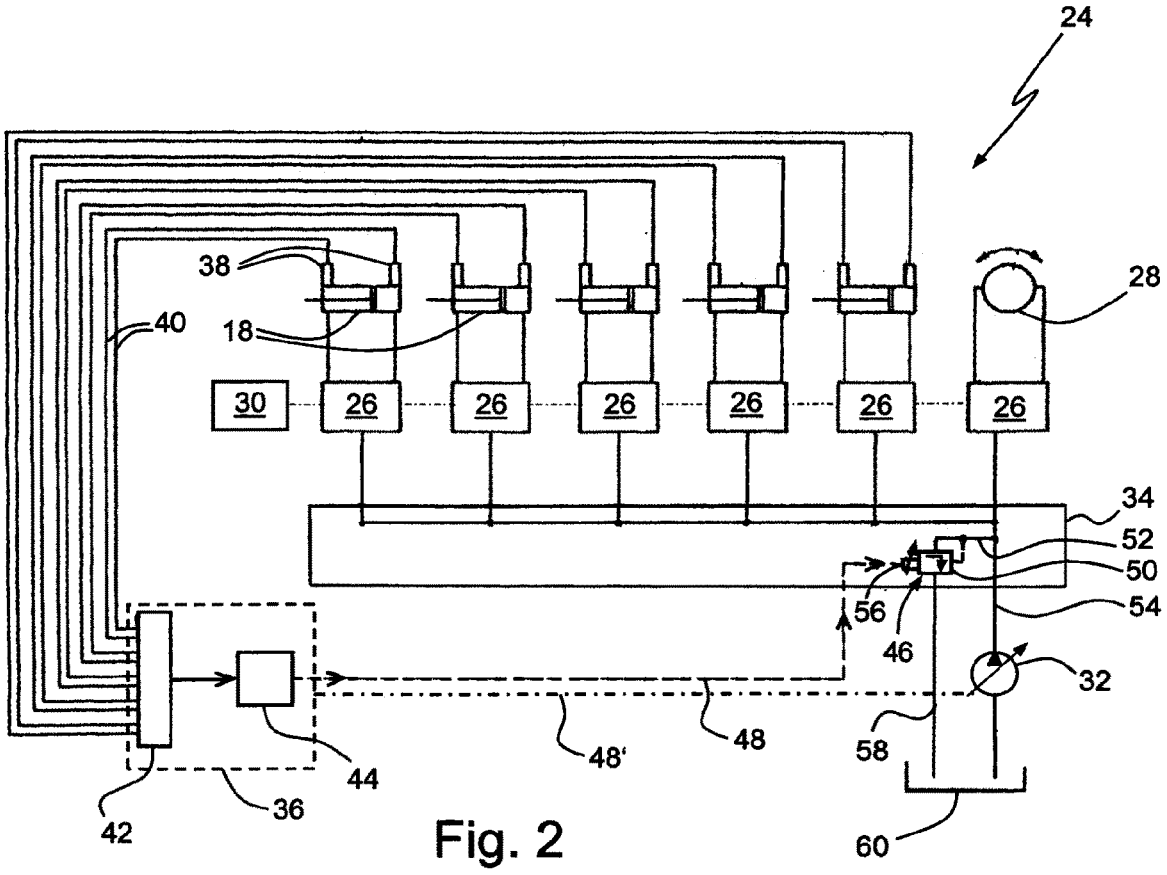
FIG. 2 shows a block diagram of a system for controlling the concrete placing boom under load pressure-dependent adjustment of the supply pressure.

FIG. 2 shows a control system 24 for the concrete placing boom 14. This includes actuators 26 for the double-acting hydraulic drive cylinders 18 and for a rotary drive 28 for rotating the boom about a vehicle vertical axis, a computer-assisted remote control unit 30 for actuating the actuators 26 under the control of an operator, and a hydraulic circuit 34 containing a hydraulic pump 32 for hydraulically actuating the drive cylinders 18 via their actuators 26 and an electronic control device 36 for load-dependent adjustment of the supply pressure supplied by the hydraulic pump 32 at least when the concrete placing boom 14 is started up.

For this purpose, each drive cylinder 18 is provided with pressure sensors 38 on the base side and the rod side, the pressure signals of which are fed as electrical output signals to a comparator 42 of the control device 36 via electrical signal lines 40. This is designed to determine the maximum pressure value from the pressure signals and to forward it to an evaluation stage 44 of the control device 36. In the evaluation stage 44, a setpoint value for the supply pressure can be determined therefrom, wherein optionally the maximum pressure value is increased by a predetermined amount. In order to set the supply pressure to this setpoint value, a pressure actuator 46 is provided, which can be controlled by the control device 36 via a control line 48.

In the embodiment shown in FIG. 2, the pressure regulator 46 comprises a pressure limiting valve 50, the input of which is connected via a branch line 52 to a feed line 54 of the hydraulic pump 32 on the outlet side. The valve is actuated via a proportional solenoid 56 at the end of the control line 48. The outlet of the pressure limiting valve 50 is connected to the tank 60 via a return line 58.

The supply pressure or delivery pressure of the hydraulic pump 32 designed as a variable pump is distributed in parallel to the actuators 26 via the hydraulic circuit 34. These are based on proportional changeover valves which can be connected to the drive cylinders 18 on the bottom or rod side and ensure hydraulic locking in their zero position, so that the boom arms 16 remain in a given position and the hydraulic pump 32 does not have to work continuously under full load.

The respective pressure in the drive cylinders 18 is influenced by the instantaneous position of the boom arms 16 and is therefore of different heights. For example, the first drive cylinder 18 near the vehicle in FIG. 1 requires the greatest pressure for the erection, while the last drive cylinder before the boom end requires less pressure for the kinking. However, the hydraulic pressure cannot be provided suddenly, but builds up over a certain time.

If the concrete placing boom 14 is now to be approached from a given position, the automatic control system 24 automatically ensures that the maximum supply pressure that is currently required is provided. For this purpose, the measurement signals of the pressure sensors 38 provided as electrical signals or current signals are processed in the comparator 42 in order to electronically or digitally determine the maximum pressure required. The evaluation stage 44, as part of a microprocessor, provides for the corresponding energization of the proportional solenoid coil 56 of the pressure limiting valve 50 in order to set the maximum pressure required as a preload pressure. This means that all drive cylinders 18 can be started up simultaneously, because none of them remain undersupplied for their required working pressure during a certain dead time. After this start-up phase, runtime effects are rather subordinate in the chain of actuators 26 and sufficient hydraulic oil is available so that the pressure control can be deactivated if necessary.

Instead of indirect pressure control by means of a controllable pressure limiting valve 50, it is also conceivable that the control unit 36 acts directly on the pivot angle of a variable pump 32 via a control line 48' and a pump regulator (not shown) in order to set a desired preload pressure.

Figure 3:
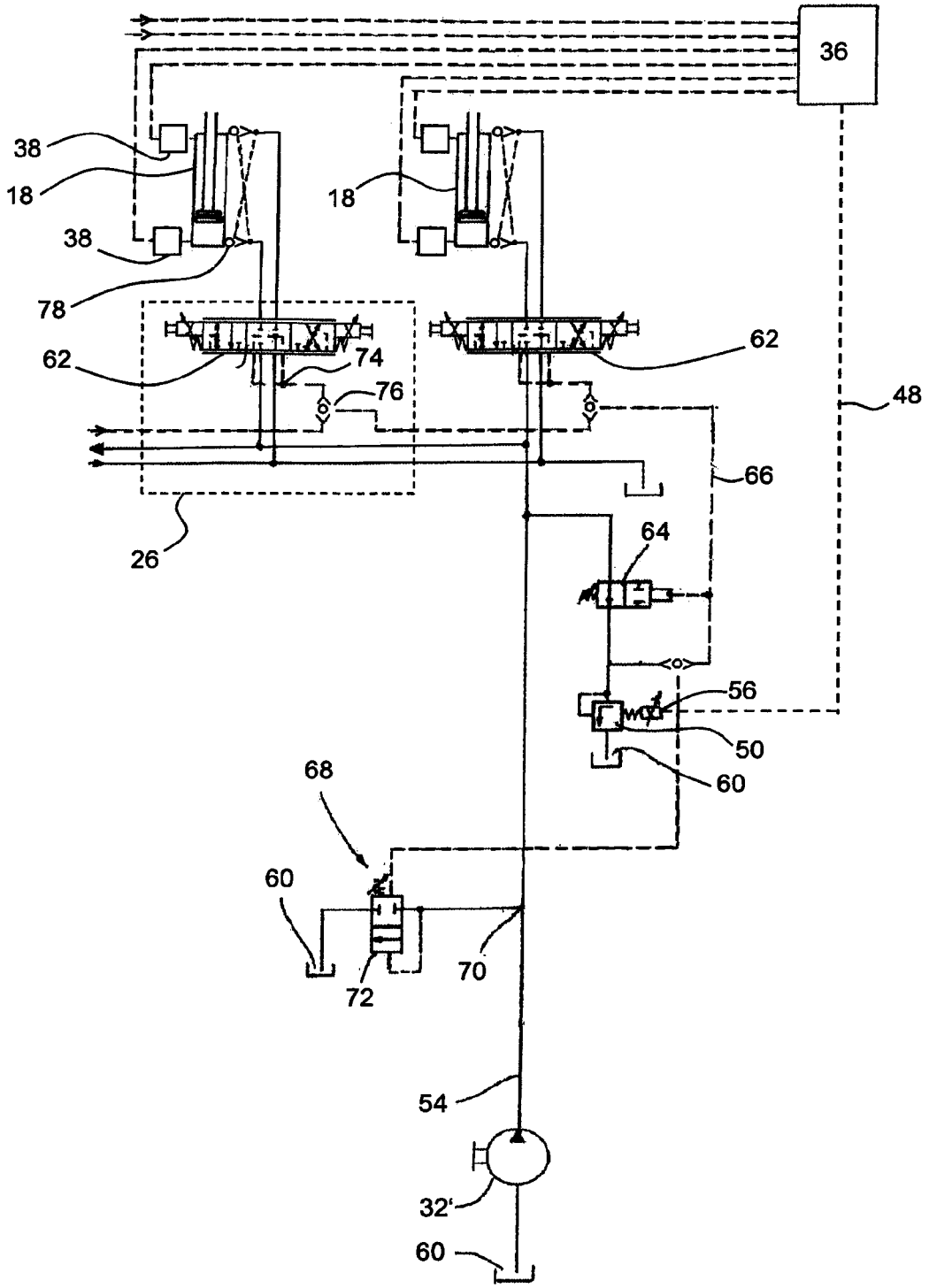
FIG. 3 shows a hydraulic circuit with a constant pump and a pressure limiting valve controlled depending on the load pressure.

FIG. 3 shows a further embodiment for the use of the control device 36 in connection with a constant pump 32', wherein only two actuators 26 with their proportional valves 62 and downstream hydraulic drive cylinders 18 are shown in the circuit diagram for simplification. There, too, the load pressure is determined via pressure sensors 38 and variably preset on the pressure limiting valve 50 via a proportional solenoid coil 56 in accordance with the maximum pressure detected. As soon as a higher pressure is required in the further boom operation, the directional control valve 64 closes and the pressure is transferred hydraulically via a load-sensing line 66 to the pressure compensator 68. There, the excess hydraulic oil is diverted from the branch point 70 to the tank 60. For this purpose, the pressure compensator 68 has a switching valve 72 which is acted upon at its one spring-biased control input by the load-sensing pressure and at its other control input by the pump pressure and accordingly controls or blocks it into an intermediate position.

As can be seen from FIG. 3, the pickups 74 for the load pressure transmission are on the supply side of the proportional valves 62. The shuttle valve chain 76 ensures that only the maximum load pressure on the load-sensing line 66 is controlled during driving operation.

In the standby mode, that is to say in the middle position of the proportional valves 62 shown, the drive cylinders 18 are locked by the load holding valves 78 and no load-sensing signal is provided. Here, the control device 36 coupled to the pressure sensors 38 enables the required prestressing in order to use electronic boom control devices (known for example as EBC, ergonomic boom control) to convert a start-up command into suitable synchronized pivoting movements of the boom arms 16 without individual drive cylinders 18 leading with a lower supply pressure requirement.

While this invention has been described as having an exemplary design, the present invention may be further modified within the spirit and scope of this disclosure. This application is therefore intended to cover any variations, uses, or adaptations of the invention using its general principles.

What is claimed is:

1. A method for the hydraulic control of a concrete placing boom comprising:

providing the concrete placing boom with a plurality of boom arms wherein the plurality of boom arms are connected to one another in an articulated manner and wherein hydraulic drive cylinders for the boom arms are controlled by a hydraulic circuit which includes a hydraulic pump;

supplying a supply pressure to the hydraulic circuit with the hydraulic pump;

providing at least one pressure sensor for each of the hydraulic drive cylinders and generating a pressure signal with each of the pressure sensors;

wherein the maximum pressure in the drive cylinders is determined from the pressure signals and the supply pressure is adjusted by an electronic control unit as a function of the maximum pressure; and wherein, after a start-up phase of the concrete placing boom, the supply pressure is adjusted by a load-sensing controller independently of the pressure signals of the pressure sensors.

2. The method according to claim 1 wherein the pressure signals are transmitted as electrical signals via electrical signal lines from the pressure sensors to the electronic control unit.

3. The method according to claim 2 wherein the electrical signals are transmitted to a comparator of the control device formed by an electronic circuit or software.

4. The method according to claim 1 wherein the pressure sensors sense pressure directly on the bottom side and/or the rod side of the drive cylinder.

5. The method according to claim 1 wherein the supply pressure is adjusted by a controllable pressure limiting valve connected via a branch line to a feed line of the hydraulic pump.

6. The method according to claim 5 wherein the pressure limiting valve is actuated by a solenoid coil controlled via an electrical control line.

7. The method according to claim 1 wherein the hydraulic pump is a constant pump.

8. The method according to claim 1 wherein the hydraulic pump is a variable pump and the supply pressure is adjusted by regulating the hydraulic pump via a hydraulic or electrical pump regulator.

9. The method according to claim 1 wherein the supply pressure is set to a value which is the same as the maximum pressure or which exceeds the maximum pressure by a predetermined amount.

10. The method according to claim 1 wherein the respective pressures in the drive cylinders are influenced by the current position of the boom arms.

11. The method according to claim 1 wherein the drive cylinders are each acted upon by a working pressure derived from the supply pressure via an associated actuator of the hydraulic circuit wherein the associated actuators take the form of proportional directional control valves.

12. The method according to claim 1 wherein the movement of the boom arms of the concrete placing boom is coordinated in a computer-assisted manner as a function of specified travel commands.

13. The method according to one of claim 1 wherein, at the beginning of a movement phase, in particular when starting the concrete placing boom, the maximum pressure is determined from the pressure signals.

14. A system for the hydraulic control of a concrete placing boom wherein the concrete placing boom includes a plurality of articulated boom arms comprising:

respective hydraulic drive cylinders for the articulated boom arms and a hydraulic circuit including a hydraulic pump for controlling the drive cylinders, wherein each drive cylinder has at least one pressure sensor which generate pressure signals indicative of pressure within the drive cylinders, wherein the respective pressure in the drive cylinders depends on the instantaneous position of the boom arms, and wherein an electronic control unit determines a maximum pressure from the pressure signals and adjusts a supply pressure generated by the hydraulic pump as a function of the maximum pressure; and wherein, after a start-up phase of the concrete placing boom, the supply pressure is adjusted by a load-sensing controller independently of the pressure signals of the pressure sensors.

15. The system according to claim 14 wherein the pressure signals output by the pressure sensors are communicated to the electronic control unit via electrical signal lines.

16. The system according to claim 14 wherein the control unit has a comparator to determine the maximum pressure from the pressure signals.

17. The system according to claim 14 wherein the control unit has an evaluation stage for determining a setpoint value of the supply pressure as a function of the maximum pressure.

18. The system according to claim 14 wherein the control unit has a hydraulic or electrical pump regulator or a controllable pressure limiting valve connected to a feed line of the hydraulic pump to adjust the supply pressure.

* * * * *